US011066750B2

(12) United States Patent
Su et al.

(10) Patent No.: US 11,066,750 B2
(45) Date of Patent: Jul. 20, 2021

(54) METAL CORROSION INHIBITION

(75) Inventors: Shiu-Chin H. Su, Croton-on-Hudson, NY (US); Suresh K. Rajamaran, Macungie, PA (US)

(73) Assignee: Momentive Performance Materials Inc., Waterford, NY (US)

( * ) Notice: Subject to any disclaimer, the term of this patent is extended or adjusted under 35 U.S.C. 154(b) by 199 days.

(21) Appl. No.: 12/675,227

(22) PCT Filed: Aug. 25, 2008

(86) PCT No.: PCT/US2008/010059
§ 371 (c)(1),
(2), (4) Date: Aug. 24, 2010

(87) PCT Pub. No.: WO2009/029243
PCT Pub. Date: Mar. 5, 2009

(65) Prior Publication Data

US 2011/0033719 A1 Feb. 10, 2011

Related U.S. Application Data

(60) Provisional application No. 60/966,341, filed on Aug. 27, 2007.

(51) Int. Cl.
*C23F 11/14* (2006.01)

(52) U.S. Cl.
CPC ..... *C23F 11/145* (2013.01); *Y10T 428/31678* (2015.04)

(58) Field of Classification Search
None
See application file for complete search history.

(56) References Cited

U.S. PATENT DOCUMENTS 2,185,095 A * 12/1939 Smith ..... C01G 49/14 210/711
3,234,144 A * 2/1966 Morehouse ..... 252/389.32
4,209,416 A * 6/1980 Hirozawa ..... C09K 5/20 252/389.32
5,767,179 A * 6/1998 Takado ..... 524/103
6,106,901 A * 8/2000 Song et al. ..... 427/387
2006/0127681 A1* 6/2006 Domes ..... C09D 4/00 428/447
2006/0193988 A1* 8/2006 Walter ..... C09D 4/00 427/387
2006/0228470 A1 10/2006 He et al.
2007/0015893 A1* 1/2007 Hakuta et al. ..... 528/34
2007/0117052 A1* 5/2007 Teranishi ..... G03C 1/005 430/567
2007/0219318 A1* 9/2007 Lin ..... A61K 8/671 525/94
2008/0081212 A1* 4/2008 Inbe et al. ..... 428/651
2012/0177826 A1* 7/2012 Kolberg et al. ..... 427/337

FOREIGN PATENT DOCUMENTS

WO 00/46311 8/2000
WO WO-0107679 A1 * 2/2001 ..... C23C 22/36
WO WO-3002773 A2 * 1/2003
WO WO-2004076717 A1 * 9/2004 ..... C09D 4/00
WO WO-2004076718 A1 * 9/2004 ..... C09D 4/00

OTHER PUBLICATIONS

Characterization of Organofunctional Silane Films on Zinc Substrates Yuan JI of Colloid and Interface Science 185 pp. 197-209 (1997).*
Dissertation, "Corrosion Protection of Galvanized Steels by Silane-based Treatments", W. Yuan. University of Cincinnati (1999).*
Child, T. F. et al, "Application of Silane Technology to Prevent Corrosion of Metals and Improve Paint Adhesion," Trans IMF, 1999, 77(2), pp. 64-70.

* cited by examiner

*Primary Examiner* — Kenneth J Stachel
(74) *Attorney, Agent, or Firm* — James C. Abruzzo

(57) ABSTRACT

A process is provided for inhibiting the corrosion of metal that comes into contact with a static or flowing aqueous medium which comprises contacting at least a portion of the exposed surface of the metal with aqueous medium containing a metal corrosion inhibiting amount of at least one ureido silane and, optionally, one or more added inorganic and/or other organic materials.

12 Claims, No Drawings

METAL CORROSION INHIBITION

BACKGROUND OF THE INVENTION

This invention relates to a process for inhibiting corrosion of metals exposed to water employing ureido silanes as corrosion inhibitors.

The corrosion of metals that are in contact with static or flowing water is a widespread problem that is encountered in a variety of industrial processes, e.g., processes for the removal of scale from metal surfaces using acid solutions which may attack the base metals, and in many kinds of apparatus and equipment such as boilers, heat exchangers, cooling towers, cooling jackets, radiators, chemical reactors, distillation columns, thin film evaporators, crystallizers, ore treatment units such as flotation tanks, settling tanks, filtration apparatus, water treatment apparatus, ion exchange apparatus, decanters and other liquid/liquid separators, spray towers, condensers, dehumidifiers, metallized surfaces and circuitry used in semiconductor manufacture, pipelines, storage tanks, washing equipment, and so forth.

Numerous materials have been employed or proposed for addition to water or aqueous media that comes into contact with metals for the purpose of inhibiting the corrosion of the metals. Included among such materials are organosilicon compounds such as aminoalkoxysilanes.

It is an object of the invention to provide a process for inhibiting the corrosion of metals that come in contact with water or aqueous media which is generally applicable to the protection of all metals encountered in industrial processes and apparatus.

It is another object of the invention to provide a process for inhibiting the corrosion of metals that comes in contact with water which is generally applicable to both pure water and aqueous solutions containing one or more dissolved organic and/or inorganic compounds.

SUMMARY OF THE INVENTION

In accordance with the present invention, there is provided a process for inhibiting the corrosion of metal that comes into contact with a static or flowing aqueous medium which comprises contacting at least a portion of the exposed surface of the metal with aqueous medium containing a metal corrosion inhibiting amount of at least one ureido silane and, optionally, one or more added inorganic and/or other organic materials.

Further in accordance with this invention, there is provided a corrosion-inhibited metal having at least a portion of its exposed surface in contact with an aqueous medium containing a metal corrosion inhibiting amount of at least one ureido silane and, optionally, one or more added organic and/or inorganic compounds dissolved in the aqueous medium.

In many cases, the ureido silanes are highly effective in inhibiting corrosion of metal surfaces in contact with an aqueous medium when present therein at very low concentrations. As such, the use of ureido silanes, a number of which are readily commercially available, provides a practical and economical solution to the problem of corrosion of metal surfaces encountered in various industrial processes, apparatus and equipment such as those mentioned above.

The term "metals" as used herein shall be understood herein to include substantially pure metals, metal alloys, laminated structures having at least one exposed metal or metal alloy layer, and the like.

The expression "aqueous medium" is inclusive of essentially pure water, water containing one or more dissolved solids, liquids and/or gases and water containing one or more undissolved solids, liquids and/or gases suspended, entrained or otherwise distributed therein, e.g., water-in-oil emulsions, oil-in-water emulsions, particulate suspensions, etc.

The expression "exposed surface" as applied to the metals herein shall be understood to mean a bare metal surface, i.e., a metal surface allowing direct contact between it and aqueous medium containing corrosion inhibiting ureido silane.

The expression "ureido silane" as used herein shall be understood to include a ureido silane per se, i.e., ureido silane with its alkoxy group(s) intact, ureido silane hydrolyzate(s) and/or to the partial or substantially complete condensate(s) of a ureido silane that are produced following the hydrolysis of the silane on exposure to water.

Other than in the working examples or where otherwise indicated, all numbers expressing amounts of materials, quantified process conditions, and so forth, stated in the specification and claims are to be understood as being modified in all instances by the term "about."

It will also be understood that any numerical range recited herein is intended to include all sub-ranges within that range and any combination of the various endpoints of such ranges or subranges.

It will be further understood that any compound, material or substance which is expressly or implicitly disclosed in the specification and/or recited in a claim as belonging to a group of structurally, compositionally and/or functionally related compounds, materials or substances includes individual representatives of the group and all combinations thereof.

DETAILED DESCRIPTION OF THE INVENTION

The invention herein is applicable to inhibiting the corrosion of all metals that are suitable for use in industrial processes and in the fabrication of many kinds of apparatus and equipment such as those mentioned above. Metals whose corrosion is inhibited by the process of this invention include magnesium and the metals below magnesium in the electromotive series, e.g., aluminum, copper, chromium, iron, manganese, nickel, lead, silver, tin, beryllium and zinc, as well as alloys of such metals, e.g., brass, bronze, solder alloys, steel, and the like). This invention is particularly applicable to the protection of brass, bronze, iron, steel, copper and aluminum.

This invention is applicable to liquids that contain some appreciable amount of water, e.g., at least 20, preferably at least 80 and more preferably at least 99, weight percent water. Suitable liquids include pure water, aqueous solutions containing inorganic solutes and solutions containing water and water soluble organic compounds, especially water soluble organic liquids. Illustrative of suitable aqueous solutions containing inorganic solutes are aqueous sodium and calcium chloride refrigerating solutions, acidified pickling solutions (e.g., aqueous sulfuric acid solution), corrosive well water or river water containing chlorides, carbonates and sulfates which may be used as process water in industry, and the like. Illustrative of suitable solutions containing water and a water soluble organic liquid are solutions containing water and monohydric or polyhydric alcohols (e.g., methanol, ethanol, propanol, ethylene glycol, propylene glycol and glycerol), hydroxyl and alkoxy end-blocked polyalkylene oxides (such as polyethylene oxide), sulfoxides (such as methyl sulfoxide), formamides (such as dimethyl formamide) or cyclic ethers free of olefinic unsaturation (such as tetrahydrofuran and dioxane) or the like.

According to one embodiment of the invention, the ureido silane metal corrosion inhibitor is at least one compound of the general formula:

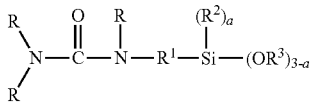

wherein each occurrence of R independently is hydrogen, alkyl of from 1 to 6 carbon atoms, cycloalkyl, alkenyl of from 1 to 6 carbon atoms, arylene or alkarylene, and specifically the R which is bound to the nitrogen atom that is a bridge between the carbonyl and $R^1$, is individually selected from the group consisting of hydrogen, methyl, ethyl, propyl, iso-propyl, butyl, iso-butyl, sec-butyl, tert-butyl, and cyclohexyl; $R^1$ is a substituted or unsubstituted aliphatic or aromatic group, specifically $R^1$ is selected from the members of the group consisting of an alkylene of from 1 to 10 carbon atoms, alkenylene of 1 to 6 carbon atoms, arylene and alkylarylene and some non-limiting examples of $R^1$ are methylene, ethylene, propylene, 2-methylpropylene and 2,2-dimethylbutylene; each $R^2$ independently is a monovalent hydrocarbon group of from 1 to 10 carbon atoms, more specifically from 1 to about 6 carbon atoms, e.g., the non-limiting examples of alkyl, aryl and aralkyl groups such as the non-limiting examples of methyl, ethyl, butyl, hexyl, phenyl, or benzyl, more specifically, the lower alkyls of from 1 to 4 carbon atoms and most specifically methyl; and, each $R^3$ is independently chosen from the group consisting of hydrogen, linear or branched alkyl, linear or branched alkoxy-substituted alkyl, linear or branched acyl, specifically $R^3$ is individually chosen from the group consisting of hydrogen, ethyl, methyl, propyl, iso-propyl, butyl, iso-butyl, sec-butyl and acetyl; and in one embodiment, at least one $R^3$ is other than hydrogen or acetyl; and a is 0, 1 or 2.

The term "substituted" as a descriptive of the aforementioned aliphatic or aromatic groups includes such groups wherein the carbon backbone may have one or more heteroatoms, e.g., oxygen, nitrogen or both, within the backbone of the ureido silane, and/or a heteroatom or heteroatom-containing group attached to the backbone of the ureido silane.

In another more specific embodiment herein, ureido silane (such as the non-limiting example of ureidoalkoxysilane) employed in this invention is a γ-ureidopropyltrimethoxysilane such as one having the structure:

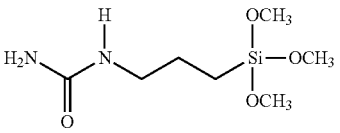

In another specific embodiment, a non-limiting example of ureido silane herein is 3-ureidopropyltriethoxysilane which can also be used to provide partial and/or substantially complete condensates mentioned above. Pure 3-ureidopropyltriethoxysilane is a waxy solid material. A solvent or means of solubilizing this material is therefore needed for it to an aqueous medium. Commercially available 3-ureidopropyltrialkoxysilane is dissolved in methanol (Silquest® A-1160, Momentive Performance Materials) and, as a result, is not a pure compound but contains both methoxy and ethoxy groups bonded to the same silicon atom.

Specific ureido silanes that can be used herein with generally good results include gamma-ureidopropyltrimethoxysilane, gamma-ureidopropyltriethoxysilane, gamma-ureidopropyldimethoxyethoxysilane, gamma-ureidopropylmethoxydiethoxysilane, gamma-ureidopropylmethyldimethoxysilane, gamma-ureidopropylmethyldiethoxysilane, gamma-ureidopropylmethylmethoxyethoxysilane, their hydrolyzates, their partial and/or substantially complete condensates, and combinations of any of the foregoing.

In the practice of this invention the ureido silane corrosion inhibitor is added to the aqueous medium and, for best results, uniformly dissolved or dispersed therein. Any suitable means can be used to dissolve or disperse the ureido silane. Thus, in the case of a flowing or moving aqueous medium that contacts the metal to be protected, the ureido silane can be added to the aqueous medium with solution or dispersion of the silane being achieved by the movement of the medium. Alternatively, the ureido silane can be added to the aqueous medium prior to its coming into contact with the metal to be protected with solution or dispersion of the silane being achieved by mechanical stirring. This latter procedure is preferred where the aqueous medium is to be stored or otherwise undergoes little movement when in use.

To facilitate dissolution or dispersion or ureido silane, a suitable solvent and/or surfactant may be employed. Examples of suitables solvents include propanol, isopropanol, 2-methyl-1,3-propane diol, n-butanol, sec-butanol, tert-butanol, hexylene glycol, trimethylol propane, and the like. The use of one or more of these and similar solvents can be advantageous for improving the stability of the ureido silane in aqueous media by inhibiting or reducing gel formation. The amount of solvent can vary considerably, e.g., from 0.1 to 10, and preferably from 0.2 to 3, parts by weight solvent per part by weight ureido silane. Suitable surfactants that may be used herein to disperse ureido silane corrosion inhibitor include the nonionic surfactants. The selected surfactant will ordinarily be used in at least a dispersion-forming amount, e.g., from 5 to 10, and preferably from 1 to 2, parts by weight per part by weight of ureido silane.

To the extent there may be a loss of ureido silane inhibitor over time, i.e., a measurable reduction in its concentration in the aqueous medium, there should be continuous or intermittent replacement of the lost inhibitor with an amount of fresh ureido silane as will maintain the desired concentration of the inhibitor at a fairly constant level.

The amount of ureido silane employed as metal corrosion inhibitor will vary widely from case to case depending on the temperature, the type of metal or metals in contact with the aqueous medium, the pH of the aqueous medium, the velocity of the aqueous medium, the presence and amount of solutes or other materials in the aqueous medium, and like considerations. In general, the concentration of the ureido silane in the aqueous medium can vary widely provided, of course, it is present therein in at least a metal corrosion inhibiting amount. Thus, concentrations of from 0.001 to 60, preferably from 0.01 to 5, and more preferably from 0.1 to 1 weight percent, are generally effective.

It may be advantageous to adjust the pH of the aqueous medium in order to inhibit or reduce any tendency of the ureido silane to form a gel precipitate. Adjustment of the aqueous medium to a pH of from 2 to 10, preferably from 2.5 to 7 and more preferably, from 3 to 5 is generally satisfactory for this purpose.

The following examples are illustrative of the invention.

Examples 1-7

A. Test Method for Evaluating Metal Corrosion Inhibition

The general method for evaluating the effectiveness of the test ureido silane metal corrosion inhibitor, in all examples, gamma-ureidoproplytrimethoxysilane (Silquest® A-1524, Momentive Performance Materials) utilized clean metal strip of 4.5 cm×1.5 cm×0.066 cm, deionized water adjusted to a pH of 4.09 with acetic acid and capped 1 ounce wide mouth bottles. The metal strips employed in the examples was initially provided in the form of unpolished, cut cold rolled steel (CRS) panels measuring 15.2 centimeters (cm)× 10.16 cm×0.066 cm supplied by ACT Laboratories. Prior to being cut into the test strips, the panels were cleaned with an alkaline cleaner in a conventional manner, rinsed with distilled water and blow-dried with nitrogen gas. Solutions of various concentrations of ureidopropyltrimethoxysilane (UPTMS) were prepared, together with several controls. Each bottle was filled to the same level with one of the aqueous media, metal strip immersed therein, the bottle capped and after a measured interval of time, the bottle visually examined for color indicative of corrosion and the presence of solids, if any.

The test solutions were set forth in Table 1 below:

TABLE 1

Test Solutions

| Test Solution | Wt. % UPTMS | Wt. % Urea |
|---|---|---|
| Control 1 (deionized water adjusted to pH 4.09) | — | — |
| Control 2 (deionized water unadjusted for pH) | — | — |
| Control 3 (deionized water adjusted to pH 4.09) | — | 5 |
| Control 4 (deionized water unadjusted for pH) | — | 5 |
| Example 1 | 20.2 | — |
| Example 2 | 10 | — |
| Example 3 | 5.1 | — |
| Example 4 | 1.1 | — |
| Example 5 | 0.55 | — |
| Example 6 | 0.1 | — |
| Example 7 | 0.06 | — |

The test results over various time intervals are set forth in Table 2 below:

TABLE 2

Results of Tests

| | Time of Immersion of Metal Strip | | | | | | | | | |
|---|---|---|---|---|---|---|---|---|---|---|
| Test Solution | 2 Hours | 2 Hours, 23 Minutes | 4 Hours, 40 Minutes | 28 Hours | Color Rating[2] | 45 Hours | 3 Days | 10 Days | 21 Days | 30 Days |
| Control 1 | NSR[1] | Rust | rust | rust | 3 | | | | | |
| Control 2 | rust | Rust | rust | rust | 5 | | | | | |
| Control 3 | NSR | Rust | rust | rust | 4 | | | | | |
| Control 4 | rust | Rust | rust | rust | 6 | | | | | |
| Example 1 | white solids, NSR | white solids, NSR | white solids, NSR | white solids, NSR | | solid mass | | | | |
| Example 2 | NSR | trace solids, NSR | trace solids, NSR | trace solids, NSR | | | NSR | milky solution, NSR | milky solution, NSR | |
| Example 3 | NSR | NSR | NSR | NSR | | | NSR | NSR | trace ppt | more ppt, slight yellow |
| Example 4 | NSR | NSR | NSR | NSR | | | NSR | NSR | NSR | NSR |
| Example 5 | NSR | NSR | NSR | NSR | | Rust | | | | |
| Example 6 | NSR | NSR | trace of rust | rust | 1 | | | | | |
| Example 7 | NSR | NSR | trace of rust | rust | 2 | | | | | |

[1]NSR = No Significant Corrosion
[2]Color Rating at 28 hours, Scale (visual) 1 = lightest, 10 = darkest Other embodiments of the invention will be apparent to those skilled in the art from a consideration of this specification or practice of the invention disclosed herein. It is intended that the specification and examples be considered as exemplary only, with the true scope and spirit of the invention being defined by the following claims.

The invention claimed is:

1. A process for inhibiting corrosion of a metal selected from the group consisting of brass, bronze, iron, steel, copper and aluminum that comes into contact with a static or flowing liquid aqueous medium, the process consisting of:

contacting at least a portion of an exposed surface of the metal with the liquid aqueous medium, wherein the liquid aqueous medium consists of:

(I) a water containing liquid, consisting of at least 20 weight percent water based on the weight of the water containing liquid, selected from the group consisting of an aqueous refrigerating solution, an acidified pickling solution, river water containing chlorides, carbonates and sulfates, corrosive well water, or a solution of water with at least one solute selected from the group consisting of, inorganic chlorides, inorganic carbonates, inorganic sulfates, water soluble liquid polyhydric alcohol, water soluble liquid hydroxyl end-blocked polyalkylene oxide, water soluble liquid alkoxy end-blocked polyalkylene oxide, water soluble liquid organic sulfoxide, water soluble liquid formamide and water soluble liquid cyclic ether free of olefinic unsaturation; and (II) at least one ureido silane metal corrosion inhibitor, selected from the group consisting of gamma-ureidopropyltrimethoxysilane, gamma-ureidopropyltriethoxysilane, gamma-ureidopropyldimethoxyethoxysilane, gamma-ureidopropylmethoxydiethoxysilane, their hydrolyzates, their partial and/or substantially complete condensates and combinations of any of the foregoing, the metal corrosion inhibitor present in a metal corrosion inhibiting amount ranging from 1.1 to 5.1 weight percent based on the weight of the liquid aqueous medium, the metal corrosion inhibitor acting to inhibit corrosion of the metal; and wherein the at least one ureido silane is uniformly dissolved in the liquid aqueous medium, the pH of the liquid aqueous medium is adjusted to a value of from 3 to 5 to inhibit the formation of a gel precipitate for a period for from 2 hours to 30 days and corrosion inhibition is provided for a period of from 2 hours to 30 days.

2. The process of claim 1 wherein the metal corrosion inhibitor consists of gamma-ureidopropyltrimethoxysilane, hydrolyzates of gamma-ureidopropyltrimethoxysilane, and partial or substantially complete condensates of gamma ureidopropyltrimethoxysilane and combinations of any of the foregoing.

3. The process of claim 1 wherein the metal is aluminum, copper or iron.

4. The process of claim 1 wherein at least 80 weight percent of the water containing liquid (I) consists of water.

5. The process of claim 1 wherein at least 99 weight percent of the water containing liquid (I) consists of water.

6. A corrosion-inhibited metal selected from the group consisting of brass, bronze, iron, steel, copper and aluminum having at least a portion of its exposed surface in contact with a static or flowing liquid aqueous medium, the liquid aqueous medium consisting of:

(I) a water containing liquid, consisting of at least 20 weight percent water based on the weight of the water containing liquid, selected from the group consisting of an aqueous refrigerating solution, an acidified pickling solution, river water containing chlorides, carbonates and sulfates, corrosive well water, or a solution of water with water soluble liquid polyhydric alcohol, water soluble liquid hydroxyl end-blocked polyalkylene oxide, water soluble liquid alkoxy end-blocked polyalkylene oxide, water soluble liquid organic sulfoxide, water soluble liquid formamide and water soluble liquid cyclic ether free of olefinic unsaturation; and (II) a ureido silane metal corrosion inhibiting amount, ranging from 1.1 to 5.1 weight percent based on the weight of the liquid aqueous medium, of at least one ureido silane selected from the group consisting of gamma-ureidopropyltrimethoxysilane, gamma-ureidopropyltriethoxysilane, gamma-ureidopropyldimethoxyethoxysilane, gamma-ureidopropylmethoxydiethoxysilane, their hydrolyzates, their partial and/or substantially complete condensates and combinations of any of the foregoing; and wherein the at least one ureido silane is uniformly dissolved in the liquid aqueous medium, and wherein the pH of the liquid aqueous medium is adjusted to a value of from 3 to 5 to inhibit the formation of a gel precipitate for a period for from 2 hours to 30 days and corrosion inhibition is provided for a period of from 2 hours to 30 days.

7. The corrosion-inhibited metal of claim 6 wherein the ureido silane is at least one member selected from the group consisting of gamma-ureidopropyltrimethoxysilane, hydrolyzates of gamma-ureidopropyltrimethoxysilane, partial or substantially complete condensates of gamma-ureidopropyltrimethoxysilane and combinations of any of the foregoing.

8. The corrosion-inhibited metal of claim 6 wherein the metal is aluminum, copper or iron.

9. The corrosion-inhibited metal of claim 6, wherein at least 80 weight percent of the water containing liquid (I) consists of water.

10. The corrosion-inhibited metal of claim 6 wherein at least 99 weight percent of the water containing liquid (I) consists of water.

11. The corrosion-inhibited metal of claim 6 in contact with a static or flowing liquid aqueous medium, wherein the corrosion inhibited metal in contact with a static or flowing liquid aqueous medium is incorporated in an apparatus, equipment or device.

12. The corrosion-inhibited metal in contact with a static or flowing liquid aqueous medium of claim 11 wherein the apparatus, equipment or device is a boiler, heat exchanger, cooling tower, cooling jacket, radiator, chemical reactor, distillation column, thin film evaporator, crystallizer, ore treatment unit, settling tank, filtration apparatus, water treatment apparatus, ion exchange apparatus, decanter, spray tower, condenser, dehumidifier, metallized surface and/or circuitry used in semiconductor manufacture, pipeline, storage tank or washing equipment.

* * * * *